US006385135B1

(12) United States Patent
Yuzuki

(10) Patent No.: US 6,385,135 B1
(45) Date of Patent: May 7, 2002

(54) ELECTRONIC TIMEPIECE AND DISPLAY METHOD OF ELECTRONIC TIMEPIECE

(75) Inventor: Toshiyuki Yuzuki, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/326,152

(22) Filed: Jun. 4, 1999

(51) Int. Cl.[7] ..... G04B 19/22
(52) U.S. Cl. ..... 368/21; 368/22
(58) Field of Search ..... 368/21–23, 82, 368/223, 239

(56) References Cited

U.S. PATENT DOCUMENTS

| | | | | | |
|---|---|---|---|---|---|
| 4,884,254 | A | * | 11/1989 | Kawai et al. | 368/21 |
| 5,299,126 | A | * | 3/1994 | Spraker | 364/420 |
| 5,477,508 | A | | 12/1995 | Will | 368/189 |
| 5,682,525 | A | * | 10/1997 | Bouve et al. | 395/615 |
| 5,832,408 | A | * | 11/1998 | Tamai et al. | 701/208 |
| 5,909,216 | A | * | 6/1999 | Matsubayashi et al. | 345/347 |

FOREIGN PATENT DOCUMENTS

| | | |
|---|---|---|
| EP | 383305 A2 | 8/1990 |
| JP | 54111865 | 9/1979 |
| JP | 56112679 | 9/1981 |
| JP | 63128493 | 8/1988 |
| JP | 03059493 | 3/1991 |

* cited by examiner

*Primary Examiner*—Vit Miska
(74) *Attorney, Agent, or Firm*—Adams & Wilks

(57) ABSTRACT

An electronic timepiece includes a memory for storing geographic data comprising a plurality of geographic locations and information pertaining to each of the locations. An input switch is used to select specific geometric data in a hierarchical manner for display. Previously-selected geographic data is separately stored so that simplified searching of the geographic data can be achieved. In one embodiment, geographic data is searched in a hierarchical manner from larger locations to smaller locations in response to sequential activation of the input switch. The geographic data comprises continents, countries, cities, and costal areas, and searching for data is performed in a hierarchical manner in response to sequential activation of the input switch so that respective continents are selected, followed by countries and then coastal areas in order to search for a specific coastal area.

29 Claims, 9 Drawing Sheets

ELECTRONIC TIMEPIECE AND DISPLAY METHOD OF ELECTRONIC TIMEPIECE

BACKGROUND OF THE INVENTION

1. Field of the Invention

The present invention relates to an electronic timepiece and a display method for an electronic timepiece, and more particularly to an electronic timepiece and a display method for an electronic timepiece which makes it easy to search object countries, cities or the like and facilitates selecting countries, cities or the like.

2. Description of the Prior Art

Conventionally, there has been widely known an electronic timepiece having a world time function for displaying names of countries or names of cities in the world as well as the time at the countries or the cities. Such a function is mainly adopted in a digital timepiece and is rarely used in a three hands type timepiece. Further, the world time function is frequently adopted not only in clocks, but also in wrist watches in accordance with multiple function capabilities of wrist watches in recent years.

In such an electronic timepiece having the world time function, names of main countries and name of main cities as well as time data of the countries or the cities are stored in a built-in memory of the main body. Further, the built-in memory is frequently provided with various data in respect of countries or cities such as currency rates, average temperatures or the like in addition to the time data. Normally, when a user selects a world time function mode by a mode select button, a display portion displays information of time and the like of the selected countries or cities. Next, by pushing a select button, while successively displaying countries or cities, countries or cities intended for display are searched.

When the user finds the countries or cities intended for display, the user stops pushing the select button. Thereby, the display portion displays information in respect of specific countries or cities. Further, when the user wants to know information for other countries or cities, the user searches for such countries or cities by again pushing the select button. When the user returns to a normal timepiece mode, the user pushes the mode select button. The user can obtain information of time and the like of respective countries in the world in this way.

However, according to the above-described conventional electronic timepiece, there may be a case in which after specific countries or cities have been selected, successive countries or cities are selected further and when a user wants to know information for previously selected countries or cities, the user is obliged to search the previous countries or cities while pushing the select button again. Further, although there is select button having the function of feeding and returning operation, when previously selected countries or cities are remote from currently selected countries or cities, it is still necessary to each the previous countries or cities while pushing the select button. Accordingly, there is a problem in that the selection of countries or cities requires much time and labor.

Particularly, in the case of a wrist watch, an area of a display portion is limited and accordingly, when a number of stored countries or cities becomes large, names of countries or names of cities which can simultaneously be displayed are limited (normally only one) and accordingly, the searching operation becomes very difficult. Further, when the object of search is at a level of a city or below, for example, names of towns or beaches, the searching operation becomes even more difficult.

Hence, the present invention has been carried out in view of the above-described situation and it is an object of the invention to provide an electronic timepiece in which it is easy to search object countries, cities or the like and which facilitates selecting countries, cities or the like.

SUMMARY OF THE INVENTION

In order to achieve the above-described object, according to a first aspect of the invention, there is provided an electronic timepiece comprising area information recording means for recording a large number of area data pertaining to plural countries, cities and the like and information data time and the like in respect of the area data, area selecting means for selecting specific area data from the area data, selected area information storing means for registering a small number of the selected area data, and the information data in respect of the area data and selected area information displaying means for displaying the selected area data and the information data in respect of the area data.

In a world timepiece, normally, a large number of countries, cities or the like are recorded. According to the invention, a small number of specific countries or the like are selected from a large number of countries or the like which have been recorded and registered. Further, names of the registered countries and information in respect of the countries were displayed. A number of the registered countries, cities or the like is small and accordingly, searching can be carried out easily. For example, when about two to five countries, cities or the like having high frequencies of use are registered, time and labor of searching is saved.

Further, according to a second aspect of the invention, there is provided an electronic timepiece wherein in an electronic timepiece having area information recording means for recording a large number of area data pertaining to plural countries, cities and the like and information data of time and the like in respect of the area data and selecting and displaying specific areas from the area data, the area data of the countries, the cities and the like recorded by the area information recording means is constructed by a hierarchy structure from larger ones in view of the areas and hierarchy searching is carried out in selecting the respective areas.

In the case in which a large number of countries or the like are recorded and specific countries are to be selected from these, a user must search them while successively displaying countries or the like. Hence, according to the invention, the area data is constructed by the hierarchy structure from larger ones in view of the areas and the hierarchy searching is carried out in selecting them. Therefore, the specific areas can easily be searched. Particularly, it is useful for a wrist watch having a small display area.

According to a third aspect of the invention, there is provided an electronic timepiece comprising area information recording means for recording area data pertaining to plural countries, cities and the like and information data of time and the like in respect of the area data in a hierarchy structure from larger ones in view of the areas, area selecting means for selecting specific area data from the area data by carrying out hierarchy searching, selected area information registering means for registering a small number of the selected area data and the information data in respect of the area data and selected area information displaying means for displaying the selected area data and the information data in respect of the area data.

According to the invention, a small number of specific areas are selected from a large number of areas which have been recorded and registered. In selecting the registered areas, the hierarchy searching is carried out. Further, names of the registered areas and information in respect of the areas are displayed. A number of the registered countries, cities or the like is small and accordingly, searching and selection can easily be carried out by using the hierarchy searching. Further, the areas having high frequencies of use are selected, registered and displayed and accordingly, necessary information can easily be provided.

Further, according to a fourth aspect of the invention, there is provided a display method of an electronic timepiece including an area information recording step of recording a large number of area data for countries, cities and the like and information data pertaining to plural time and the like in respect of the area data, an area selecting step of selecting specific area data from the area data, a selected area information registering step of registering a small number of the selected area data and the information data in respect of the area data and a selected area information displaying step of displaying the selected area data and the information data in respect of the area data.

According to the invention, a small number of specific countries or the like are selected from a large number of countries which have been recorded and registered and names of the registered countries and information in respect of the countries are displayed. A number of the registered countries, cities or the like is small and accordingly, searching can be carried out easily.

Further, according to a fifth aspect of the invention, there is provided a display method for an electronic timepiece wherein in a display method of an electronic timepiece for recording a number of area data returning to plural countries, cities and the like and information data of time and the like in respect of the area data and selecting and displaying specific areas from the area data, The recorded area data of the counties, the cities and the like is constructed by a hierarchy structure from larger ones in view of the areas and hierarchy searching is carried out in selecting the areas.

According to the invention, the area data is constructed by the hierarchy structure from larger ones in view of the areas and the hierarchy searching is carried out in the selecting operation. Therefore, the specific areas can easily be searched.

Further, according to a sixth aspect of the invention, there is provided a display method for an electronic timepiece comprising an area information recording step of recording area data of countries, cities and the like and information data of time and the like in respect of the area data by a hierarchy structure from larger ones in view of the areas, an area selecting step of selecting specific area data from the area data by carrying out hierarchy searching, a selected area information registering step of registering a small number of the selected area data and the information data in respect of the area data and a selected area information displaying step of displaying the selected area data and the information data in respect of the area data.

According to the invention, a small number of specific areas or the like are selected from a large number of areas or the like which have been recorded and registered and the hierarchy searching is carried out in selecting the areas. Further, names of the registered areas and information in respect of the areas are displayed. A number of the registered countries, cities or the like is small and therefore, searching and selection can easily be carried out by using the hierarchy searching. Further, the areas having high frequencies of use are selected, registered and displayed and accordingly, necessary information can easily be provided.

BRIEF DESCRIPTION OF THE DRAWINGS

A preferred form of the present invention is illustrated in the accompanying drawings in which.

DETAILED DESCRIPTION OF THE PREFERRED EMBODIMENTS

Figure 1:
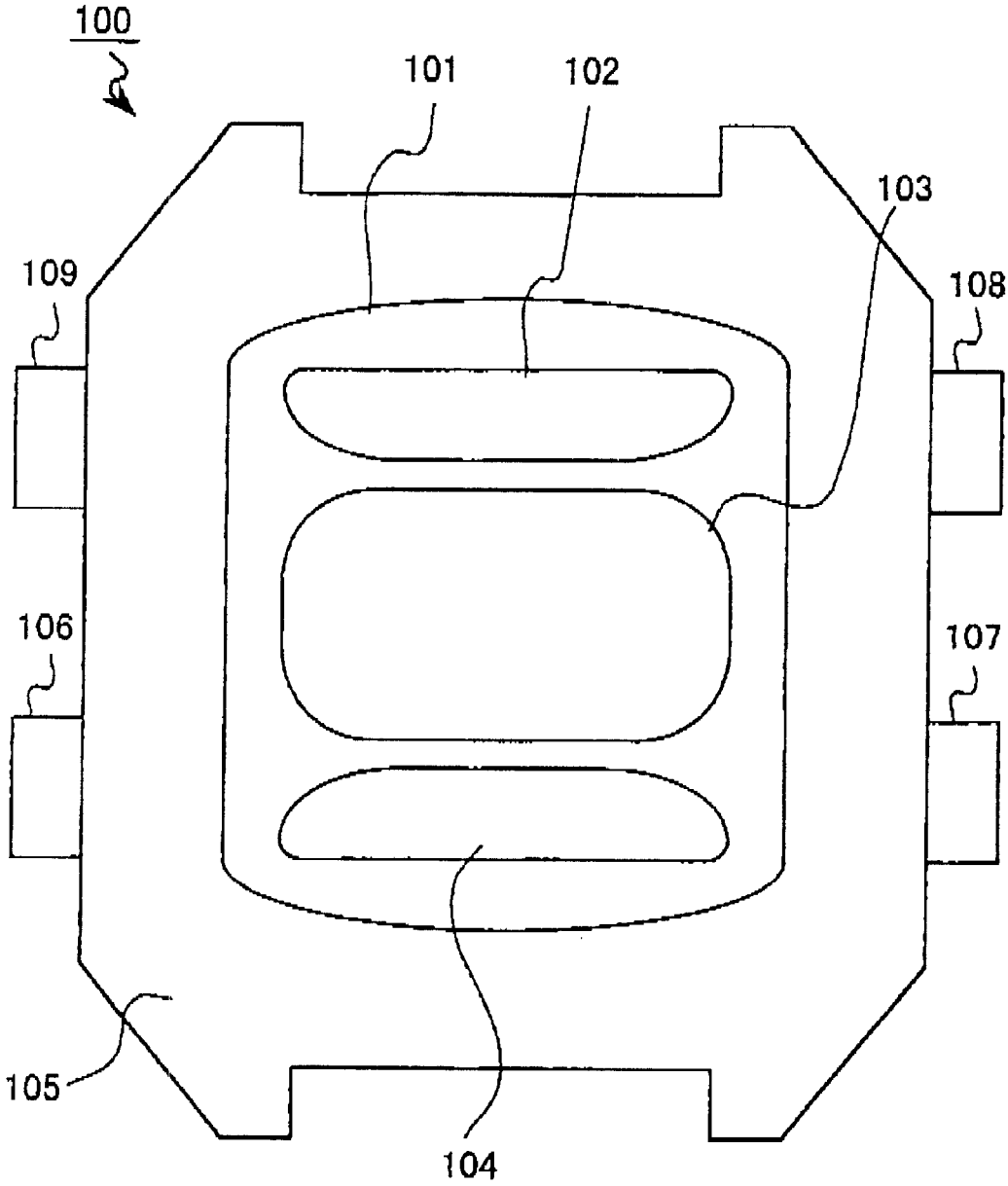
FIG. 1 is an explanatory view showing a display portion of an electronic timepiece according to an embodiment of the invention.

A detailed explanation will be given of the invention in reference to the drawings as follows. Further, the invention is not limited to embodiments thereof. FIG. 1 is an explanatory view showing a display portion of an electronic timepiece according to an embodiment of the invention. An electronic timepiece 100 according to the invention is a world timepiece of a digital quartz type but a combination quartz timepiece combined with a multiple hands type quartz (illustration is omitted) also constitutes an object. A liquid crystal panel 101 of the electronic timepiece 100 is installed with an area information displaying portion 102 for displaying areas such as names of countries, names of cities or the like, an information displaying portion 103 for displaying time of areas displayed in the area information displaying portion 102 and other information and a tidal change information displaying portion 104 for displaying tidal change information of the areas by graphs. A case 105 of the electronic timepiece 100 is installed with a mode select button 106, a select button 107, a set button 108 and an adjust button 109.

Figure 2:
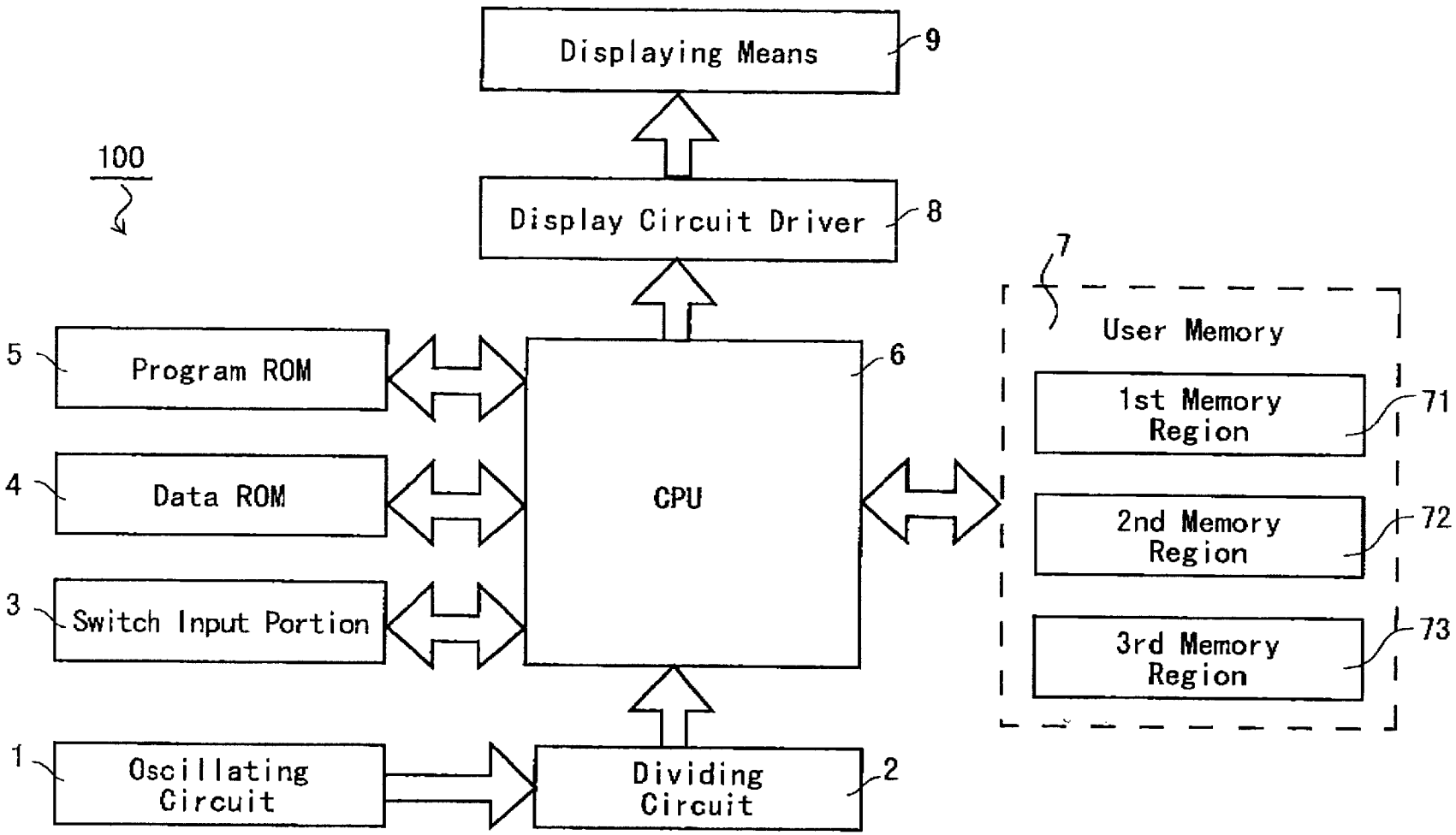
FIG. 2 is a constitution view showing the electronic timepiece shown by FIG. 1.

FIG. 2 is a constitution view showing the electronic timepiece shown by FIG. 1. The electronic timepiece 100 is constituted by an oscillating circuit 1 as well as a dividing circuit 2, a switch input portion 3 of the mode select button or the like, a data ROM (area information recording means) 4 for recording area data of countries, cities or the like and information data in respect of the area data, a program ROM 5 for recording information used for data processing or programs for controlling the timepiece, CPU 6 for processing information data in accordance with the programs and controlling all circuits of the timepiece, a user memory (selected area information registering means) 7 for recording information data selected by a user and a display driver circuit 8 as well as displaying means such as a liquid crystal panel 9.

A user memory 7 is constituted by RAM and is provided with three memory regions 71 through 73. Further, although not illustrated, the oscillating circuit 1, the user memory 7 and the like are supplied with power from a primary battery or other power supply (illustration is omitted). Further, the area selecting means specified in the scope of claims is constituted by the programs and CPU. Further, area data of countries or the like recorded in the data ROM 4 is constructed by a hierarchy structure from larger ones in view of the areas (specific examples will be mentioned later).

Figure 3:
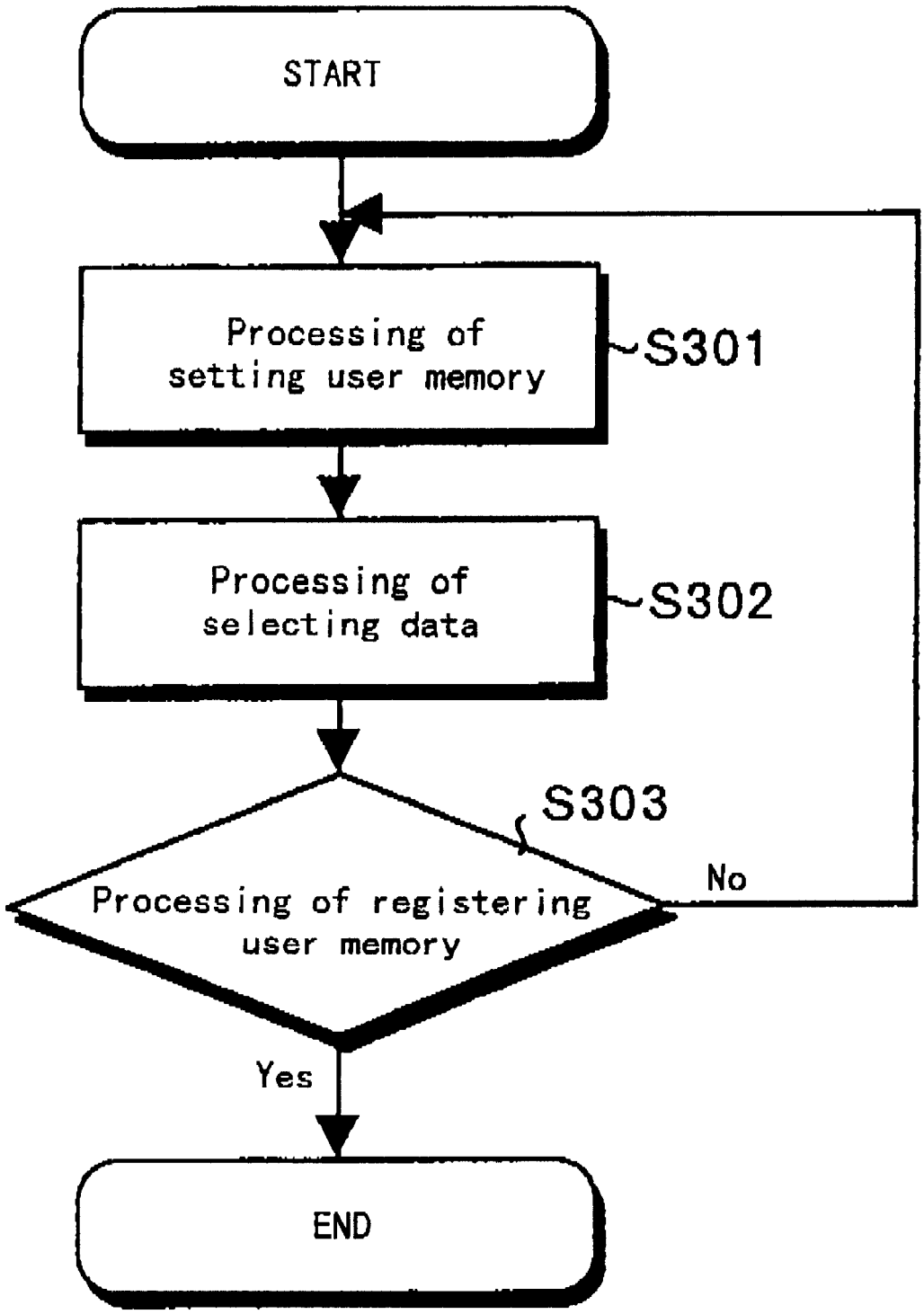
FIG. 3 is a flowchart showing basic operation of an electronic timepiece.

FIG. 3 is a flowchart showing basic operation of the electronic timepiece. At step S301, a setting process for setting any one of the three memory regions 71 through 73 of the user memory 7 is carried out. In the user memory 7, information data in respect of specific countries or cities is registered. At step S302, a data selecting processing is carried out. By the processing, object countries, cities or the like are selected. In the data selecting processing, a predetermined data selection displaying processing is carried out at the liquid crystal panel 101. At step S303, whether a registering processing to the user memory 7 has been finished is determined.

The user memory 7 is provided with the three memory regions and accordingly, three specific countries, cities or the like can be registered. After the registration, the liquid crystal panel 101 is changed to a world timepiece mode by the mode select button 106. Information in respect of the three registered countries or the like is successively displayed by pushing the select button 107. Further, the number of countries or the like which can be registered is not limited to three. Further, although the select button 107 is installed at a side face of the main body case, it may be installed at a front face of the main body case such that it can be operated easily.

Next, a detailed explanation will be given of the above-described specific operation.

[Step S301: User Memory Setting Processing]

Figure 4:
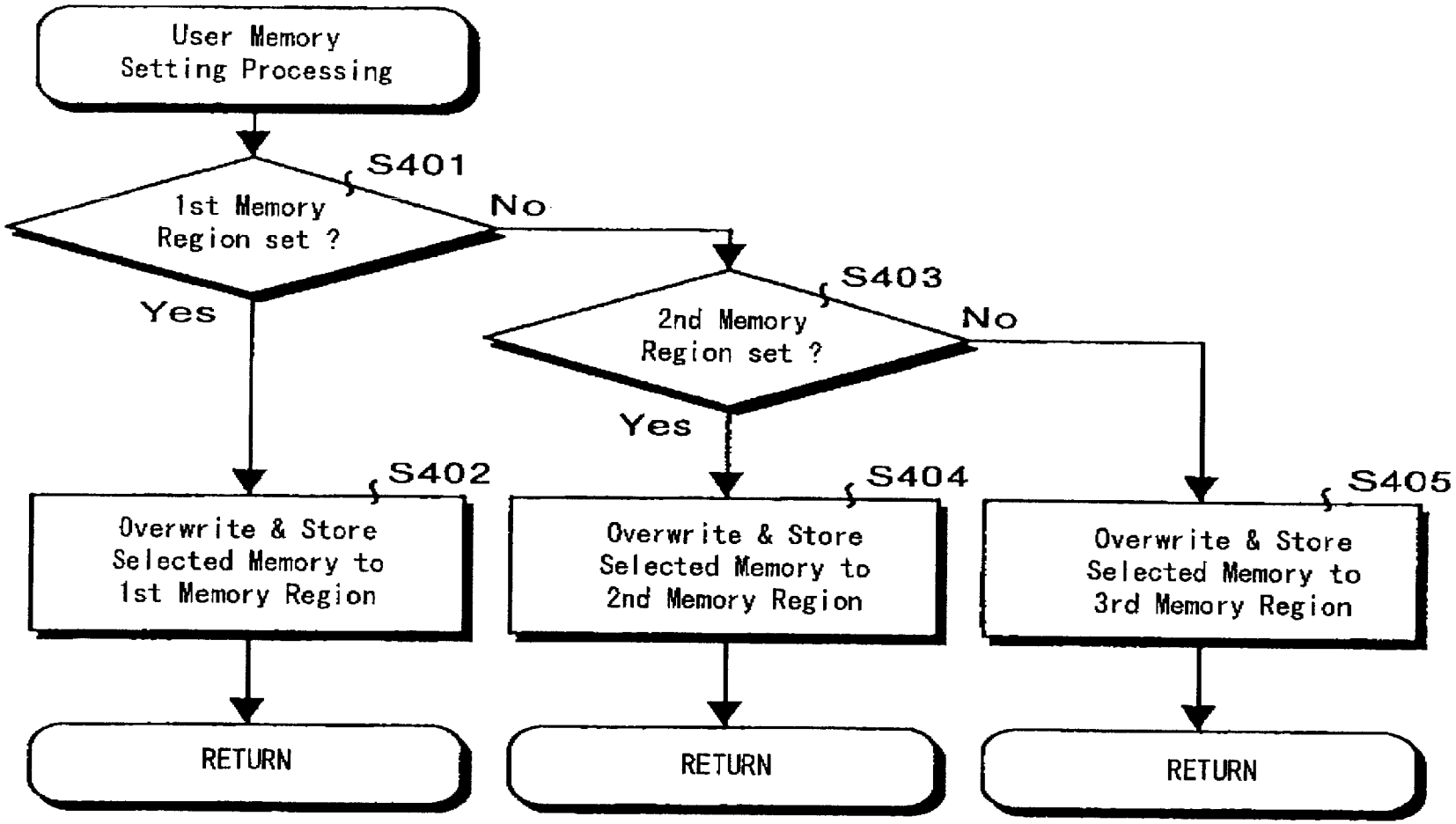
FIG. 4 is a flowchart showing details of a user memory registering processing.
Figure 5A:
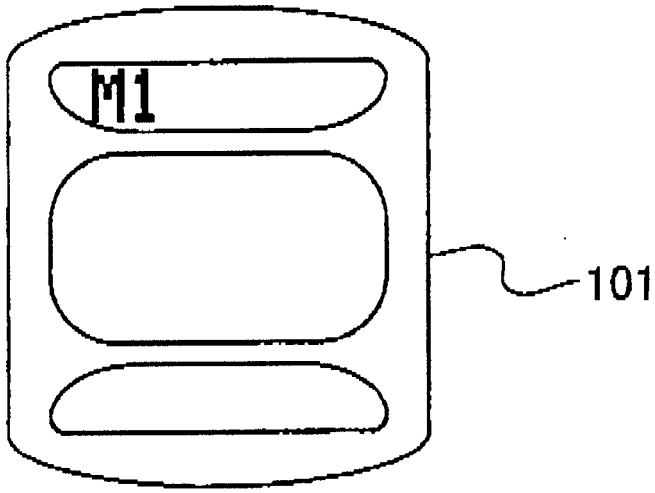
FIGS. 5A–5C illustrate explanatory views showing display examples in the user memory registering processing.

FIG. 4 is a flowchart showing details of the user memory setting process. First, the operation shifts to the user memory setting processing mode by the mode select button 106. At step S401, whether data is registered to the first memory region 71 is determined. Under the state, a display of "M1" is carried out as shown by FIG. 5A on the liquid crystal panel 101. In registering data to the first memory region 71, the operation proceeds to step S402, mentioned later. When data is to registered to the first memory region 71, the select button 107 is pushed and the operation shifts to the second memory region 72. At step S402, information data in respect of selected countries, cities or the like are registered by overwriting them on the first memory region 71. Further, details of processing for selecting countries of the like will be described below.

Figure 5B:
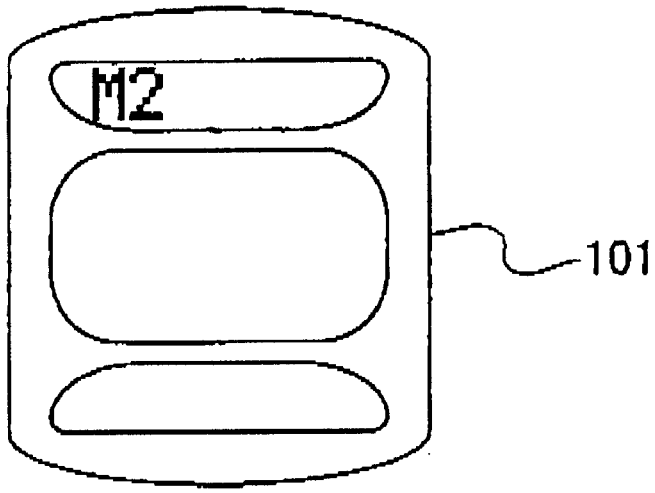

At step S403, whether data is registered to the second memory region 72 is determined. Under the state, a display of "M2" is carried out as shown by FIG. 5B on the liquid crystal panel 101. When data is registered to the second memory region 72, the operation proceeds to S404, mentioned later. When data is not registered to the second memory region 72, the select button 107 is pushed and the operation shifts to the third memory region 73. At step S404, similar to the above-described step S402 information data in respect of selected countries, cities or the like is registered by overwriting them on the second memory region 72.

Figure 5C:
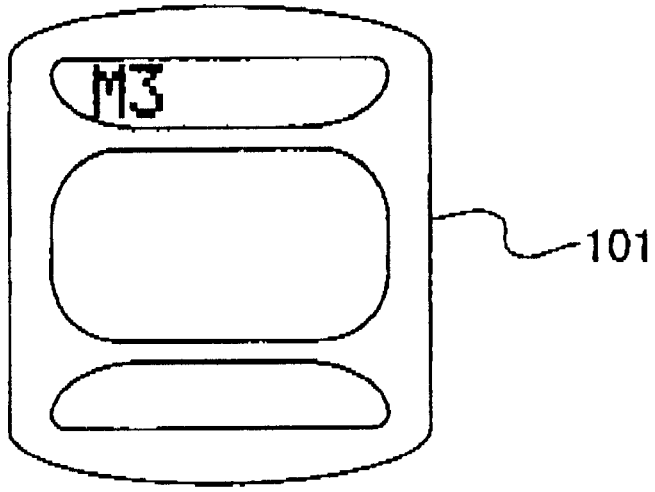

At step S405, data is registered to the third memory region 73 and a display of "M3" is carried out as shown by FIG. 5C on the liquid crystal panel 101. Further, similar to the above-described steps S402 and S404 information data in respect of the selected countries, cities or the like is registered by overwriting them on the third memory region 73.

[Step S302: Data Selecting Processing]

Figure 6:
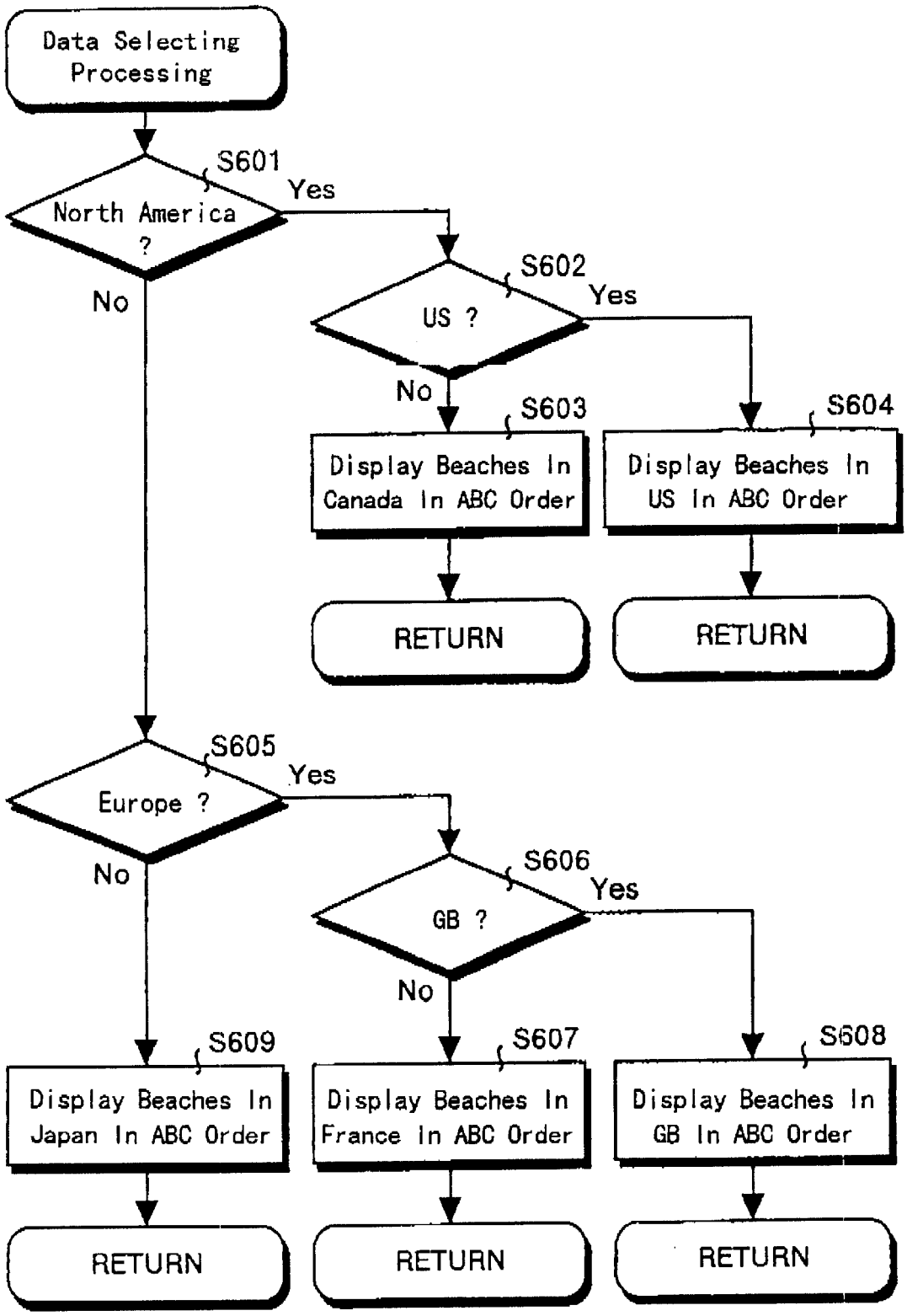
FIG. 6 is a flowchart showing details of a data selecting processing.

FIG. 6 is a flowchart showing details of the data selecting processing. In respect of countries, cities, towns, beaches or the like, a number thereof is large and accordingly, selection is carried out by hierarchical searching. In this case, an explanation will be given by showing specific examples of the hierarchy processing and a description will be given later of an actual displaying processing of the liquid crystal panel 101.

For example, an explanation will be given of a case in which beaches in any country of Canada, the United States, France, Great Britain and Japan are selected. At step S601, whether, for example, "North America" is selected is determined in any area level. When "North America" is selected, selection at a country level is successively carried out. When "North America" is not selected, selection of other area level is carried out. At step S602, in view of the country level, whether "United States" is selected is determined. When "United States" is not selected, "Canada" is selected. At step S603, in the case of selecting "Canada", selection at a beach level in the country of Canada is carried out. At step S604, a case of selecting "United States", selection at a beach level in the country of United States is carried out.

Meanwhile, at step S605, in other area level, whether, for example, "Europe" is selected is determined. When "Europe" is selected, selection at a country level is successively carried out. When "Europe" is not selected, selection at other area level is carried out. At step S606, in a country level, whether "Great Britain" is selected is determined. When "Great Britain" is not selected, "France" is selected. At step S607, in the case of selecting "France", selection at a beach level in the country of France is carried out. At step S608, when "Great Britain" is selected, selection at a beach level in the country of Great Britain is carried out. At step S609, selection at a beach level in the remaining country of Japan is carried out.

[Step S302: Data Selecting Processing]

Figure 7:
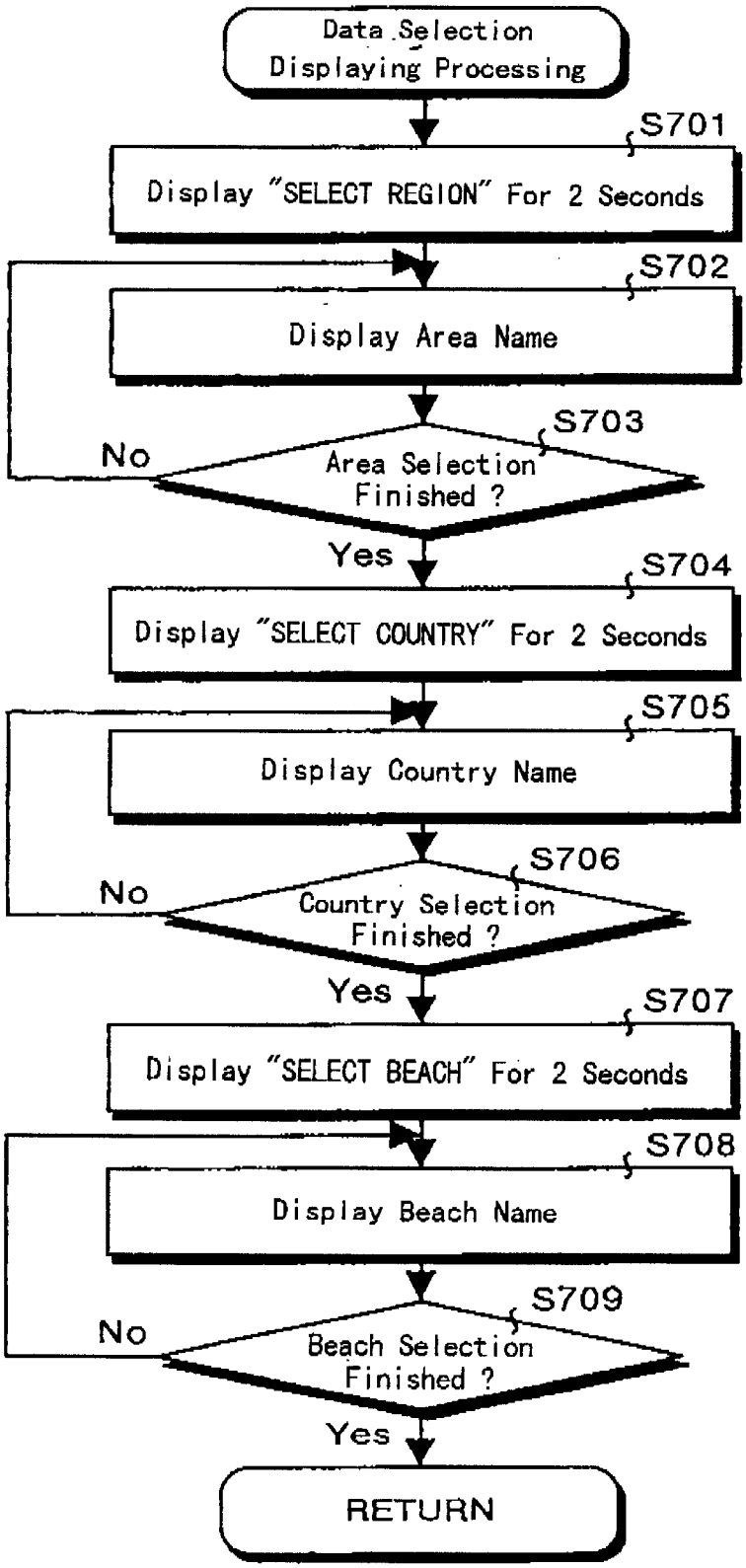
FIG. 7 is a flowchart showing details of a data selection displaying processing.
Figure 8A:
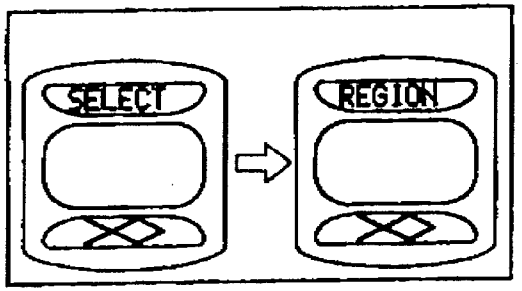
FIGS. 8A–8F illustrate explanatory views showing display states of a liquid crystal panel.
Figure 8B:
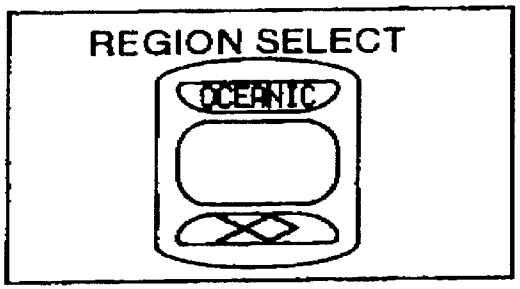

FIG. 7 is a flowchart showing details of the data selection displaying processing in the above-described data selecting processing. FIGS. 8A–8F illustrate explanatory views showing display states of the liquid crystal panel 101. At step S701, when the adjust button 109 is pushed in a state in which any memory region of the first memory region 71, the second memory region 72 and the third memory region 73 is selected, as shown by FIG. 8A, "SELECT REGION" is displayed for about 2 seconds at the area information displaying portion 102. At step S702, names of areas are displayed at the area information display unit 102. For example, at every time of pushing the set button 108, "North America", "Europe", "Asia" and the like are successively displayed. At step S703, when a currently displayed area is intended to selected selection of area is finished and selection at a country level is carried out by pushing the select button 107. For example, as shown by FIG. 8B, "Oceanic" is selected.

Figure 8C:
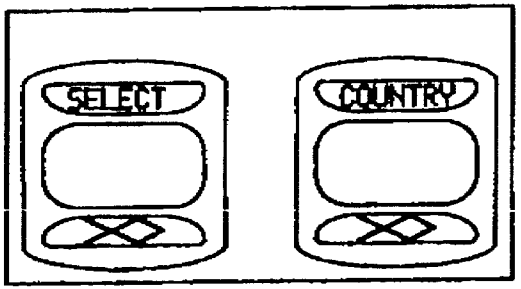
Figure 8D:
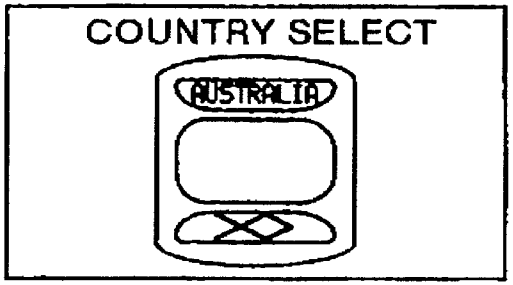

At step S704, as shown by FIG. 8C, "SELECT COUNTRY" is displayed for about 2 seconds at the area information displaying portion 102. At step S705, a name of a country is displayed at the area information displaying portion 102. For example, since "Oceanic" is selected in the above-described area selection and accordingly, at every time of pushing the set button 108, "Australia", "New Zealand", "Fiji" and the like are successively displayed. At step S706, when a currently displayed country is intended to be selected, selection of the country is finished by pushing the select button 107 and selection at a beach level is carried out. For example, as shown by FIG. 8D, "Australia" is selected.

Figure 8E:
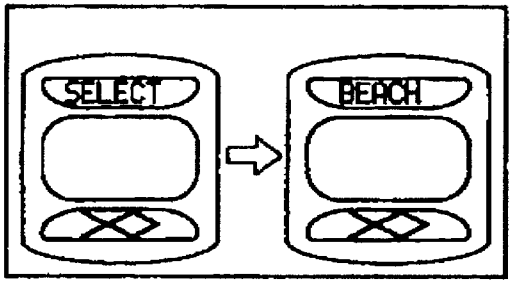
Figure 8F:
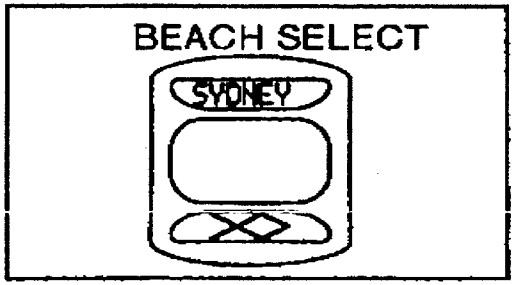

At step S707, as shown by FIG. 8E, "SELECT BEACH" is displayed for about 2 seconds at the area information displaying portion 102. At step S708, names of beaches are displayed at the area information displaying portion 102. For example, "Australia" is selected in selecting country and accordingly, at every time of pushing the set button 108, "Sydney", "Gold Coast", "Sunshine Coast" and so on are successively displayed. At step S709, when a currently displayed beach is intended to be selected, by pushing the adjust button 109, selected data is overwritten and the registered to the selected memory region. For example, as shown by FIG. 8F, "Sydney" is selected.

Figures 9A, 9B, 9C:
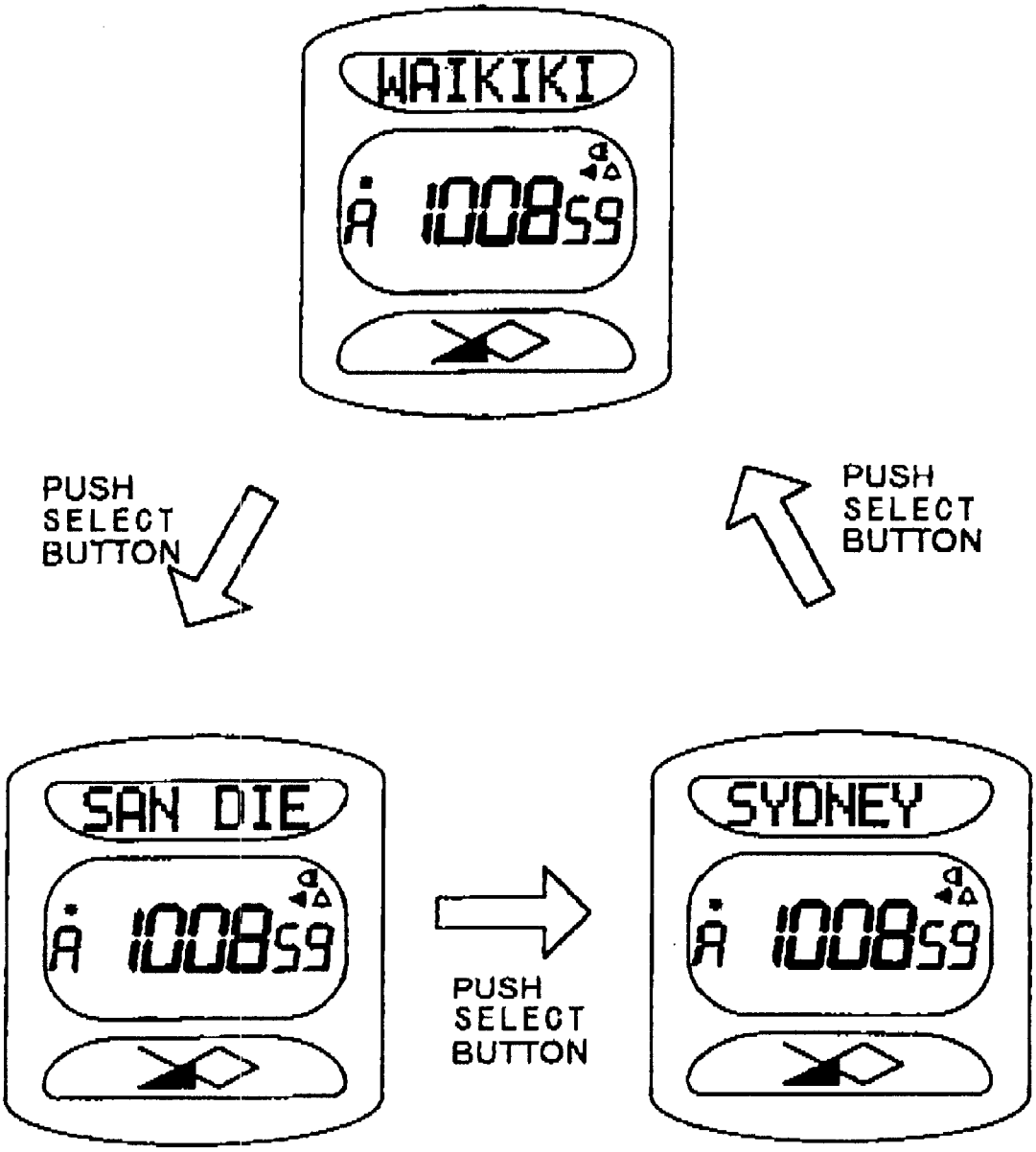
FIGS. 9A–9C illustrate explanatory views showing display examples of information used for registered in a user memory.

FIGS. 9A–9C illustrate explanatory views showing display examples of information registered in the user memory 7. By registering information of specific countries, cities or the like on the respective memory regions 71 through 73 as mentioned above, information of these can continuously be displayed. For example, tidal change information of "Waikiki", "San Diego" and "Sydney" is registered respectively to the memory regions 71 through 73 by the above-described procedure. When the user selects a world display function by the select button 106, tidal change information of a first one of plural beaches, for example, "Waikiki" is firstly displayed in the liquid crystal panel 101 (FIG. 9A in the drawing). Next, when the user selects the select button 107, tidal change information of a second beach "San Diego" is displayed (FIG. 9B in the drawing). Further, when the select button 107 is pushed once more, tidal change information at a third beach "Sydney" is displayed (FIG. 9C in the drawing).

As described above, according to the electronic timepiece 100, information of frequently used countries or the like is registered in the user memory 7 and accordingly, time and labor is not required in searching countries or the like. Further, the hierarchy searching can be carried out and accordingly, object countries, cities or the like are easy to search. Particularly, it is effective in a timepiece such as a wrist watch having a limited display space.

Further, the above-described hierarchy searching is not limited in registering information of countries or the like but is applicable also in searching object countries in a normal world timepiece. In this way, object countries are easy to search.

As has been explained, according to the electronic timepiece and the display method of an electronic timepiece of the invention, a small number of specific countries or the like are selected from a large number of countries or the like which have been recorded and registered and information of names of registered countries and information in respect of the countries is displayed and accordingly, object areas can easily be searched.

Further, according to the electronic timepiece and the display method of an electronic timepiece of the invention, the area data is constituted by the hierarchy structure from larger ones in view of the areas and the hierarchy searching is carried out in the selecting operation. Accordingly, specific areas can easily be searched. Particularly, it is useful in a wrist watch having a small display area.

Further, according to the electronic timepiece and the display method of an electronic timepiece of the invention, a small number of specific areas are selected from a large number of areas which have been recorded and the registered. Further, in selecting the registered areas, the hierarchy searching is carried out. Further, names of the registered area and information in respect of the areas are displayed. Accordingly, the selected areas can easily be searched. Further, areas having high frequencies of use are selected, registered and displayed and accordingly, necessary information can easily be provided.

What is claimed is:

1. An electronic timepiece comprising:

area information storing means for storing in a first location area data comprising a plurality of geographic locations and information data including time data for each of the plurality of locations;

area selecting means for selecting data for a specific location from the area data;

selected area information storing means for allowing a user to select one or more geographic locations of primary interest by operation of an input switch and storing in a second location different from the first location area data and information data for the at least one geographic location of primary interest; and selected area information displaying means for displaying the area data and the corresponding information data for a selected location, data for the geographic locations of primary interest being displayed before data for other geographic locations.

2. An electronic timepiece according to claim 1; wherein the geographic locations include coastal areas.

3. An electronic timepiece according to claim 2; wherein the time data includes tide information for the coastal areas.

4. An electronic timepiece according to claim 1; wherein the area data is stored in a hierarchical structure from larger geographic locations to smaller geographic locations.

5. An electronic timepiece according to claim 4; wherein the area data comprises continents, countries, cities, and costal areas; and further comprising selecting means for selecting and displaying area data in a hierarchical manner in response to sequential activation of an input switch so that respective continents are sequentially displayed first in response to the sequential activation of the input switch and, in response to selection of a continent, respective countries within the selected continent are displayed in response to the sequential activation of the input switch and, in response to selection of a country, coastal areas within the selected country are displayed in order to search for a specific coastal area.

6. An electronic timepiece according to claim 1; wherein the area data comprises continents, countries, and locations in specific countries; and further comprising selecting mean for selecting and displaying area data in a hierarchical manner in response to sequential activation of an input switch so that respective continents are selected and sequentially displayed first in response to the sequential activation of the input switch and, in response to selection of a continent, respective countries within the selected continent are displayed in response to the sequential activation of the input switch and, in response to selection of a country, locations in the selected country are displayed in order to search for a specific location in a specific country.

7. In an electronic timepiece having area information storing means for storing area data comprising a plurality of geographic locations and information data including time data for each of the plurality of locations, selecting means for selecting data for specific geographic locations from the area data, and displaying means for displaying selected data:

wherein the selecting means includes means for enabling a user to select area data stored by the area information storing means in a hierarchical manner by sequentially displaying larger geographic locations in response to sequential activation of an input switch and, in response to user selection of one of the larger geographic locations, sequentially displaying smaller geographic locations within the selected larger geographic location in response to sequential activation of an input switch.

8. An electronic timepiece according to claim 7; wherein the geographic locations include coastal areas.

9. An electronic timepiece according to claim 8; wherein the time data includes tide information for the coastal areas.

10. An electronic timepiece according to claim 9; wherein the area data is stored in a hierarchical structure from larger geographic locations to smaller geographic locations.

11. An electronic timepiece according to claim 9; wherein the area data comprises continents, countries, cities, and costal areas; and the selecting means includes means for selecting and displaying area data in a hierarchical manner in response to sequential activation of an input switch so that respective continents are sequentially displayed first in response to the sequential activation of the input switch and, in response to selection of a continent, respective countries within the selected continent are displayed in response to the sequential activation of the input switch and, in response to selection of a country, coastal areas within the selected country are displayed in order to search for a specific coastal area.

12. An electronic timepiece according to claim 2; wherein the area data comprises continents, countries, and locations in specific countries; and the selecting means includes means for selecting and displaying area data in a hierarchical manner in response to sequential activation of an input switch so that respective continents are sequentially displayed first in response to the sequential activation of the input switch and, in response to selection of a continent, respective countries within the selected continent are displayed in response to the sequential activation of the input switch and, in response to selection of a country, locations within the selected country are displayed in order to search for a specific location in a specific country.

13. An electronic timepiece comprising:

area information storing means for storing area data comprising a plurality of geographic locations and information data including time data for each of the plurality of locations;

area selecting means for enabling a user to select data for specific geographic locations from the area data in a hierarchical manner by sequentially displaying larger geographical locations in response to sequential activation of an input switch by the user and, in response to user selection of one of the larger geographic locations, sequentially displaying smaller geographic locations within the selected larger geographic location in response to sequential activation of an input switch;

selected area information storing means for allowing the user to select one or more geographic locations of primary interest by operation of an input switch and storing separately from the area information storing means area data and the corresponding information data for the at least one geographic location of primary interest; and selected area information displaying means for displaying selected area data and the corresponding information data, data for the geographic locations of primary interest being displayed before data for other geographic locations.

14. An electronic timepiece according to claim 13; wherein the geographic locations include coastal areas.

15. An electronic timepiece according to claim 14; wherein the time data includes tide information for the coastal areas.

16. An electronic timepiece according to claim 15; wherein the area data is stored in a hierarchical structure from larger geographic locations to smaller geographic locations.

17. An electronic timepiece according to claim 13; wherein the area data comprises continents, countries, and locations in specific countries; and the selecting means includes means for selecting and displaying area data in a hierarchical manner in response to sequential activation of an input switch so that respective continents are selected and sequentially displayed first in response to the sequential activation of the input switch and, in response to selection of a continent, respective countries within the selected continent are displayed in response to the sequential activation of the input switch and, in response to selection of a country, locations within the selected country are displayed in order to search for a specific location in a specific country.

18. A display method for an electronic timepiece, comprising the steps of:

an area information storing step for storing in a first location area data comprising a plurality of geographic locations and information data including time data for each of the plurality of locations;

an area selecting step for selecting data for specific geographic locations from the area data;

a selected area information registering step for selecting one or more geographic locations of primary interest by operation of an input switch and storing in a second location different from the first location area data and the corresponding information data of the geographic locations of primary interest; and a selected area information displaying step for displaying selected area data and the corresponding information data, data for the geographic locations of primary interest being displayed before data for other geographic locations.

19. A display method for an electronic timepiece, comprising the steps of: storing area data comprising names of countries, cities and other regions and corresponding information data including time data for each of the countries, cities and other regions; selecting specific areas from the area data; and displaying the selected areas along with the corresponding information data; wherein the selecting step for selecting area data is performed in a hierarchical manner by sequentially displaying larger geographical locations in response to sequential activation of an input switch and, in response to selection of one of the larger geographic locations, providing a display of smaller geographic locations within the selected larger geographic location in response to sequential activation of an input switch.

20. A display method for an electronic timepiece comprising the steps of:

an area information storing step for storing in a first location area data comprising a plurality of geographic locations and information data including time data for each of the locations in a hierarchical structure from larger locations to smaller locations;

an area selecting step for selecting a specific location from the area data in a hierarchical manner by sequentially displaying larger locations and, in response to selection of one or the larger geographic locations, providing a display of smaller geographic locations within the selected larger geographic location;

a selected area information storing step for selecting one or more geographic locations of primary interest by operation of an input switch and storing in a second location different from the first location area data and the corresponding information data for the geographic locations of primary interest; and a selected area information displaying step for displaying selected area data and the corresponding information data, data for the geographic locations of primary interest being displayed before data for other geographic locations.

21. An electronic timepiece comprising:

a memory for storing geographic data comprising a plurality of geographic locations and information pertaining to each of the geographic locations;

selecting means including an input switch for selecting specific geographic data in a hierarchical manner by sequentially displaying larger geographic locations in response to sequential activation of an input switch and, in response to selection of one of the larger geographic locations, sequentially displaying smaller geographic locations within the selected larger geographic location in response to sequential activation of an input switch; and display means for displaying the selected geographic locations and the corresponding information pertaining thereto.

22. An electronic timepiece according to claim 21; further comprising a selected area information memory for storing data for one or more of the geographic locations of primary interest as indicated by operation of an input switch.

23. An electronic timepiece according to claim 21; wherein the selecting means includes means for selecting geographic data in a hierarchical manner from larger geographic locations to smaller geographic locations in response to sequential activation of the input switch.

24. An electronic timepiece according to claim 21; wherein the geographic locations include coastal areas.

25. An electronic timepiece according to claim 24; wherein the information pertaining to the geographic locations includes time data for the geographic locations.

26. An electronic timepiece according to claim 25; wherein the information pertaining to the geographic locations includes tide information for the coastal areas.

27. An electronic timepiece according to claim 24; wherein the geographic area data is stored in a hierarchical structure from larger geographic locations to smaller geographic locations.

28. An electronic timepiece according to claim 24; wherein the geographic data comprises continents, countries, cities, and costal areas; and the selecting means includes means for sequentially selecting and displaying data in a hierarchical manner in response to sequential activation of the input switch so that respective continents are displayed in response to sequential activation of the input switch and, in response to selection of a continent, countries within the selected continent are sequentially displayed in response to sequential activation of the input switch and, in response to selection of a country, coastal areas within the selected country are sequentially displayed in order to search for a specific coastal area.

29. An electronic timepiece according to claim 21; wherein the geographic data comprises continents, countries, and locations in specific countries; and the selecting means includes means for sequentially selecting and displaying geographic data in a hierarchical manner in response to sequential activation of the input switch so that respective continents are displayed in response to sequential activation of the input switch and, in response to selection of a continent, countries within the selected continent are sequentially displayed in response to sequential activation of the input switch and, in response to selection of a country, locations within the selected country are sequentially displayed in order to search for a specific location in a specific country.

* * * * *